United States Patent [19]

Di Cicco et al.

[11] 4,345,615

[45] Aug. 24, 1982

[54] MULTIPHASE MODULAR CHEMICAL PROCESSING STATION

[75] Inventors: Angelo S. Di Cicco, Sunnyvale; Walter N. Quave, South San Francisco, both of Calif.

[73] Assignee: Kay Plastic Products, Inc., Tempe, Ariz.

[21] Appl. No.: 130,149

[22] Filed: Mar. 13, 1980

[51] Int. Cl.[3] ..... B08B 15/02

[52] U.S. Cl. ..... 137/343; 98/115 LH; 137/374; 137/376; 312/198; 312/209; 312/228

[58] Field of Search ..... 4/619, 630, 638, 639, 4/640; 55/DIG. 18; 98/115 LH; 137/343, 374, 376; 312/107, 198, 236, 209, 228

[56] References Cited

U.S. PATENT DOCUMENTS 3,129,436 4/1964 Mustee ..... 4/640

3,715,972 2/1973 Kelso et al. ..... 98/115 LH

OTHER PUBLICATIONS

IBM Technical Disclosure Bulletin, vol. 15, No. 4, Sep. 1972, Crouse et al.

*Primary Examiner*—Gerald A. Michalsky

*Attorney, Agent, or Firm*—Thomas E. Schatzel

[57] ABSTRACT

A multiphase modular chemical processing station including an exterior frame in the shape of an open rectangular solid, a plumbing-electrical structure extending across the lower back portion of such frame, the plumbing-electrical structure including liquid and gaseous input and exhaust connections as well as electrical connections and being divided into four specific module attachment positions, and a plurality of structurally similar interchangeable processing modules for mating with the plumbing-electrical structure and fitting within the exterior frame, each of the modules including a body element, the body having a cavity in its interior, a drawer extending forward from the lower portion of the body, and a work surface extending across the upper surface of the body, and each module further including a neck portion having ventilation means therein and extending upward to an upper portion containing a control panel for the module.

16 Claims, 12 Drawing Figures

MULTIPHASE MODULAR CHEMICAL PROCESSING STATION

BACKGROUND OF THE INVENTION

1. Field of Invention

The present invention relates to chemical handling apparatus and more particularly to a station for handling a variety of chemical processes and operations.

2. Description of the Prior Art

A great number of industries utilize chemical processing stations. These stations are primarily utilized for batch processing of various components or materials.

An industry in which the use of chemical processing stations has become particularly important is the semiconductor wafer industry. Silicon semiconductor wafers are created and treated utilizing a number of chemical processes. The wafers are typically processed in a batch manner. That is, a relatively small number of wafers are hand or machine processed through a variety of small chemical baths. This limited volume technique is desirable due to the fragility of the wafers. It is also desirable to maintain the best possible quality control by individual handling and inspection of the wafers.

One of the major difficulties involved in chemical processing stations for the semiconductor industry is that a large variety of different processes may be required. Depending on the type of wafer desired, the number and type of chemical processes through which the wafer is put differ greatly. Consequently, a chemical processing station intended to handle the complete processing of varying types of wafers must be very flexible as to the different chemical processes which can be conducted.

A further difficulty encountered in the chemical processing of semiconductor wafers is that many of the chemicals utilized are extremely toxic and/or very corrosive to ordinary container materials. One of the chemicals frequently utilized in this industry is hydrofluoric acid (HF). HF is an extremely toxic and corrosive chemical which is very dangerous for an operator to handle and will also corrode and eat through ordinary container materials such as all metals and glass. Various solvents utilized in the processing industry, such as methyl-ethyl-ketone (MEK) have the opposite effect of being highly destructive towards plastics and other synthetic materials. Consequently, the choice of material and arrangement of chemical processing areas within the stations are of particular importance.

The toxicity and volatility of many chemicals also creates a problem in that various chemicals must be vented to prevent their dispersion into the air and particularly into the work area in which a processing technician must work. For this reason, a chemical processing station must include ventilation means for drawing the toxic fumes away for safe processing. Care must also be taken that mutually reactive fumes, such as certain strong acids and certain organic solvents, are not mixed in the fume removal apparatus.

The attempts of the prior art to deal with these problems have been, in the main, haphazard. A typical chemical processing station will be custom built for the particular application and will be constructed of the particular materials and in the particular configuration required for this specific application. This type of custom production of each individual work area greatly increases manufacturing costs while limiting usefulness of each area to a particular process.

Another difficulty encountered by prior art chemical processing stations is that mutually reactive chemical reagents must usually be separated by a significant distance due to fume interaction and spillage interaction. This is a major impediment to efficient processing and can again increase cost of manufacture since each element must be separately manufactured.

A further disadvantage to the prior art method of constructing chemical processing stations is the lack of flexibility and the accompanying difficulty of rapid replacement. When a portion of a custom built processing area malfunctions or needs to be replaced or repaired, it is difficult to quickly make such replacements and repair since the new component must be custom manufactured. Also, the stations are frequently constructed such that the various components are difficult to reach and are thus difficult to replace. Furthermore, advancing technology frequently provides new and different process techniques which require complete replacement of prior equipment.

No prior art chemical processing stations for the semiconductor wafer industry are modularly interchangeable, that is, designed such that one area of the station may be rapidly replaced and/or interchanged with other areas. None of the prior art attempts adequately solve the aforementioned problems which are present in the semiconductor industry.

SUMMARY OF THE INVENTION

It is therefore an object of the present invention to provide a chemical processing station that is modularly interchangeable so as to be extremely flexible in its application.

It is a further object of the present invention to provide a chemical processing station which is capable of handling mutually reactive chemicals without requiring total separation of the work areas.

It is a further object of the present invention to provide a modular chemical processing station constructed out of materials which will not be destructively acted upon by the chemicals handled therein.

Briefly, a preferred embodiment of the present invention is a modular chemical processing station including a exterior frame for receiving four individual modules, the frame including overhead lighting and air pressure supply means and further including a plumbing-electrical structure containing the input and exhaust hook-up means of the flowable materials to be utilized or produced at the stations as well as electrical connections. The input and exhaust hook-up means included in exterior frame are identical for each of the four module attachment positions. The remaining elements of the modular chemical processing station are a series of individual processing modules, each of which is very similar in overall shape and size and has identical input and exhaust configurations for mating with the hook-ups on the frame. Each of the modules has a width of approximately ¼ of the entire width of the frame and each individual module is adapted such that various specific changes may be made to its work surface and control means for the application of a number of different chemical processing procedures. The modules also contain storage areas underneath the work surfaces.

It is an advantage of the present invention in that each of the processing modules may be interchanged with each of the others in a very quick and economical manner.

It is another advantage of the present invention that the capacity to expand a station from one to four modules is inherent as the station will function as filled or partially filled.

It is a further advantage of the present invention that the variety of possible modules is essentially unlimited for use within the same basic work station and that the same basic work station may be adapted to any of the large number of applications.

It is yet another advantage of the present invention that replacement and repair of the elements contained in the work processing station is accelerated and made extremely easy by the modular construction and "down time" is thus effectively reduced.

It is a further advantage of the present invention that new improved processng techniques and equipment may be incorporated for a portion of the processes without requiring the replacement of the entire unit by replacing obsolete modules with new ones.

It is a further advantage of the present invention that the materials selected for the individual modules may vary depending upon the specific application.

These and other objects and advantages of the present invention will become apparent after reading the following detailed description of the preferred embodiment which is illustrated in the several drawing figures.

IN THE DRAWING

DESCRIPTION OF THE PREFERRING EMBODIMENT

Figure 1:
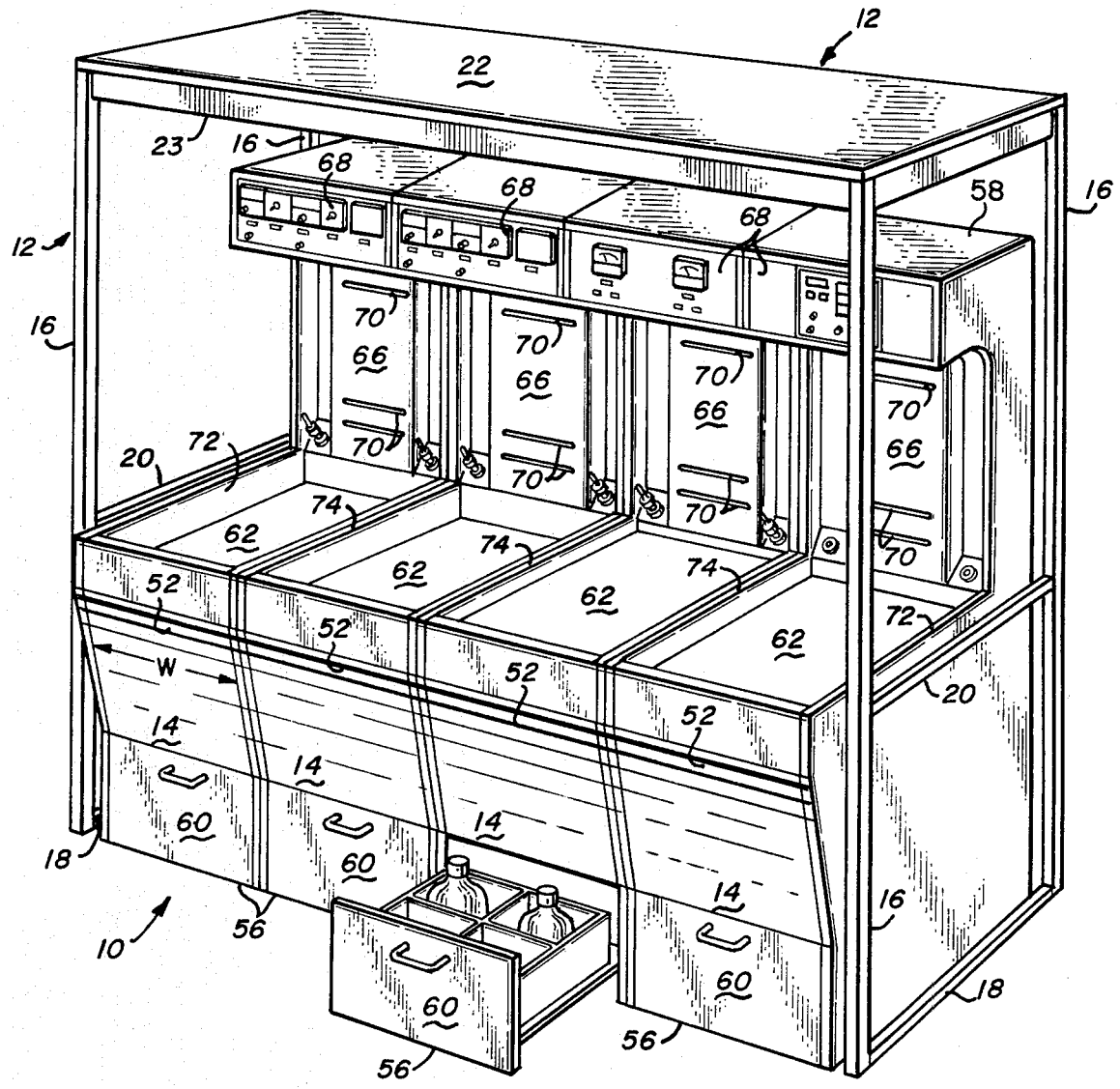
FIG. 1 is a perspective view of a modular chemical processing station of the present invention.

The preferred embodiment of the present invention, designated by the general reference character 10, is a multi-phase modular chemical processing station. The station is designed to be adaptable to a large and varied number of chemical processing applications. The station is designed to accommodate liquid and gaseous materials for usage in processes for preparation and treatment of semiconductor wafers.

As illustrated in FIG. 1, the multi-phase modular chemical processing station 10 includes an exterior frame 12 which encompasses the entire station, and a number of discrete individual processing modules 14 which are adapted to be contained within the frame 12. Each of the main elements includes a number of various subelements which may be arranged in a plurality of different configurations. In the illustrated preferred embodiment, the number of modules 14 which fit into the frame 12 is four.

Figure 2:
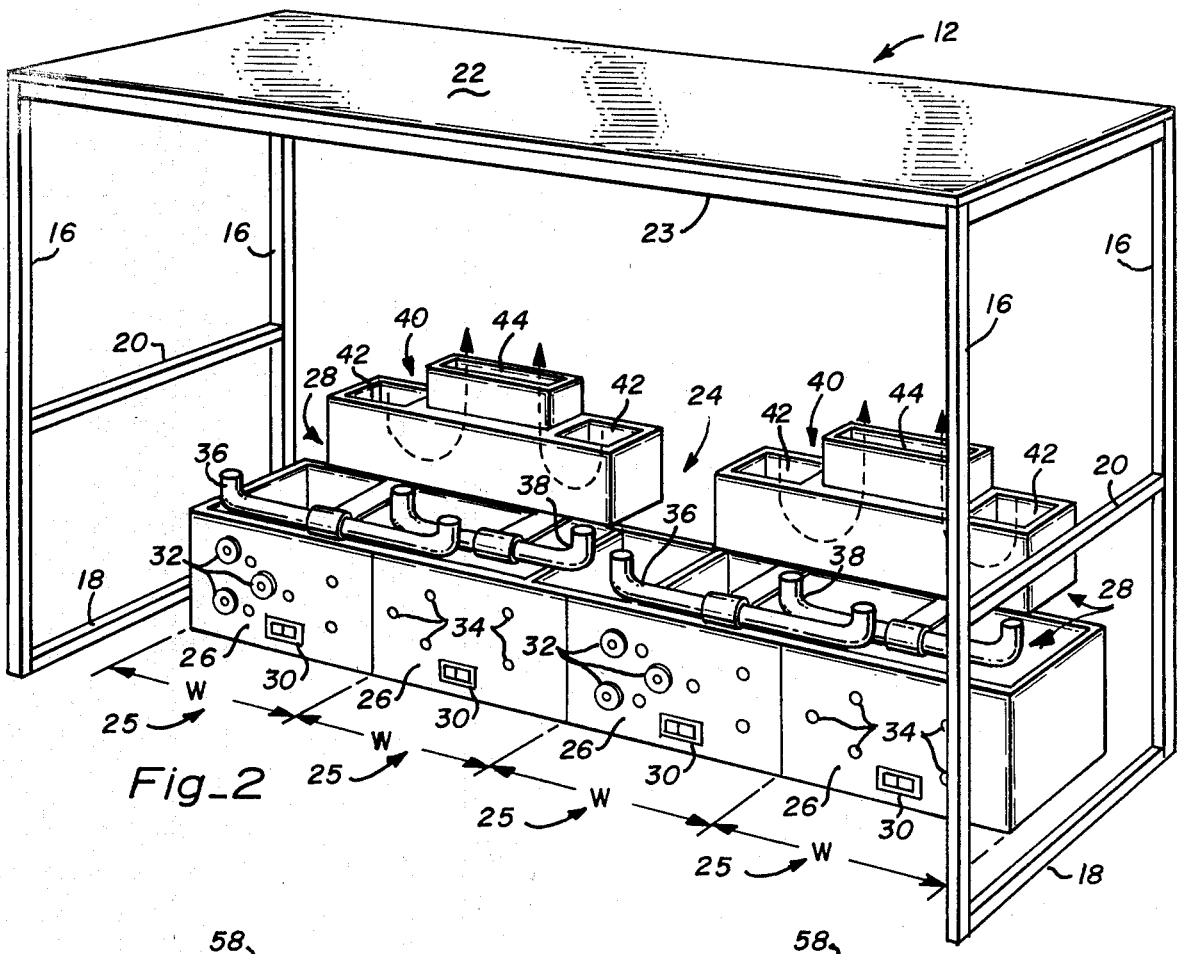
FIG. 2 is a perspective view of the exterior frame portion and the plumbing-electrical structure of the station.

The elements of the exterior frame 12 are illustrated both in FIG. 1 and FIG. 2. FIG. 2 is a perspective view of the frame 12 with the modules removed. The frame 12 is in the shape of a rectangular solid and includes four vertical struts 16 situated at the corners. The vertical struts are connected to each other at each end by a base strut 18 and a cross strut 20 partway up the vertical strut 16. An overhead planar member 22 provides the upper surface of the frame 12. Overhead member 22 contains lighting means 23 for providing illumination to the processing area contained within the frame 12. Lighting means 23 are ordinary electrical lamps such as incandescent or flourescent mounted within overhead member 22 to illuminate the work area.

Situated within frame 12 and at the back bottom portion thereof is a plumbing-electrical structure 24. Structure 24 provides the means by which the various modules are connected both to the station itself and to receive the various materials and energy sources to which inputs are required to the module as well as disposal and exhaust structures. The plumbing-electrical structure 24 is symmetrically divided into four similar module receiving positions 25. Each position has a width "w" equal to the exterior width of the module 14. An assembly 26 of module input elements are situated on the front surface of plumbing-electrical structure 24 while an assembly 28 of output or exhaust manifolds are situated on the top surface of the plumbing-electrical structure 24. The input assemblies 26 include an electrical outlet 30 at each of the four module positions 25, a number of flow controls 32 and a number of flow outlets 34. The flow controls 32 are situated at every other module attachment position 25. Each flow control 32 controls the degree of flow to one or more of the flow outlets 34 located both at the position 25 where the control 32 is situated and also at the adjacent position 25. In the preferred embodiment, the three flow controls 32 illustrated for each pair of positions 25 control a total of ten flow outlets, with five at each position 25. In a typical semiconductor wafer application, the flowable materials controlled by flow controls 32 include deionized water, compressed air and compressed nitrogen. In other cases where reduced quality control is necessary, one of these elements may be replaced by ordinary water or perhaps by a specialty chemical such as an organic solvent. The controls 32 and outlets 34 are designed to be adaptable for receiving and transmitting either gaseous or liquid flowable material.

The plumbing-electrical structure 24 also includes a plurality of output manifolds 28 to which the individual modules 14 will attach. These output manifolds 28 include a first liquid exhaust manifold 36, a second liquid exhaust manifold 38 and a gaseous exhaust manifold 40 for each pair of module postions 25. First liquid exhaust manifold 36 and second liquid exhaust manifold 38 are virtually identical in that they are pipe structures having openings at each end for receiving liquids from two adjacent module positions 25 at which they are situated and carrying the liquids to the proper disposal facilities. Two liquid exhaust manifolds are required since chemical processing of semiconductor wafers produces a number of low toxicity wastes such as ordinary water with a low concentration of impurities as well as some high toxicity wastes such as strong acids or organic solvents. It is also possible that the liquid wastes involved might be mutually reactive. Consequently, it is necessary to have at least two liquid disposal means from each processing site 25.

A gaseous exhaust manifold 40 directs the gaseous waste materials, such as toxic fumes from some of the chemicals and reactions and carries the fumes to an area where they may be treated, filtered or otherwise neutralized. Gaseous exhaust manifold 40 includes a pair of input ports 42 and an exhaust port 44. Input ports 42 are designed to interconnect with the gaseous exhaust means attached to the associated module 14 and receive gaseous exhaust therefrom. The exhaust gases from each of the two modules 14 which attached to the two associated input ports 42 will be joined and carried through the exhaust port 44, as illustrated by the broken lines in FIG. 2, to another area where the exhaust gases may be created.

The frame 14 and the plumbing-electrical structure 24 will be essentially universal for any processing station 10. The exact composition of the flowable materials inputted through the plumbing structure 24 may differ and the types of materials carried through the exhaust manifolds 40 may differ but the basic structure will remain the same.

The frame 12 and the plumbing-electrical structure 24 are designed to receive the individual modules 14 as shown in FIG. 1. When the modules 14 are in place within the frame 12 and attached to the plumbing-electrical structure 24, the input ports 34 are connected to the modules by flexible hoses. Positioning the module necessarily includes attaching the module to the liquid exhaust manifolds 36 and 38 and the input port 42 on the gaseous exhaust manifold 40. It is to be noted that not every position on the plumbing and electrical structure 24 need be utilized. If, for example, only three modules 14 are utilized the exhaust manifolds at the remaining site 25 may be sealed. In this manner only the needed modules 14 are installed. It is also to be noted that the flow outlets 34 are each designed so that they do not automatically provide flow when flow controls 32 are turned on. Instead, each flow outlet 34 contains an internal valve which prevents flow unless a hose connector or other element including a device which automatically opens the valve is attached to the outlet 34. Thus, a vacancy at one end of the module sites 25 does not impair the station in any way.

The individual modules 14 are main elements of the multi-phase modular chemical processing station 10. As shown in FIG. 1, station 10 is designed to accommodate four such modules 14. The modules 14 themselves are best illustrated in FIGS. 1, 3, 4 and 5. Each module 14 has an identical basic structure, in that the overall shape and size is the same of that of every other module 14. The differences between the modules 14 consist of differences in the control panels, work surfaces, and interior designs of the individual modules. Each module 14 is designed such that it will easily and quickly mate with the plumbing-electrical structure 24 illustrated in FIG. 2 and can be quickly hooked-up with the input ports 34 and exhaust manifolds 28 contained on that structure.

Each module 14 includes a relatively hollow exterior frame 46. The module frame 46 is symmetrical about a vertical plane bisecting the frame front to back. The frame includes a left side 48 illustrated in FIG. 3 and a right side 50 illustrated in FIG. 1. Left side 48 and right side 50 are identical in configuration and size. Both the left side 48 and the right side 50 are solid planar components.

The module 14 includes a front wall 52 (see FIG. 4) and a back wall 54 (see FIG. 5) which are solid planar members. Modules 14 further include a base wall 56, a top wall 58 and a drawer member 60.

Figure 5:
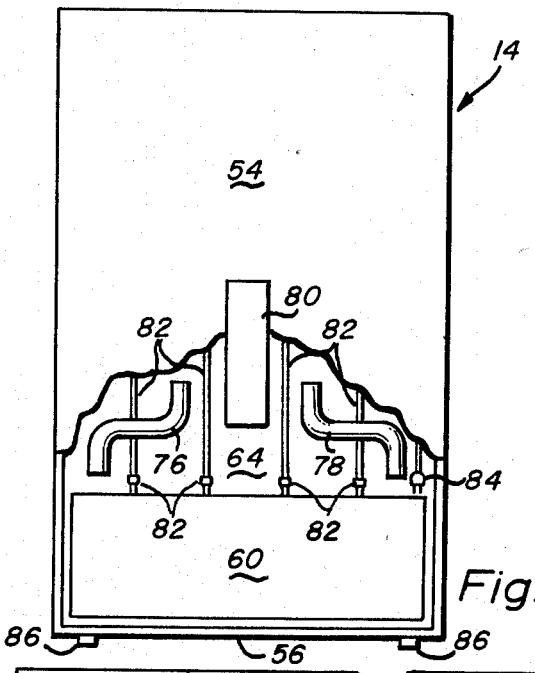
FIG. 5 is a back view of a module, partially cut away to show the manner in which the plumbing connections are made.
Figure 6:
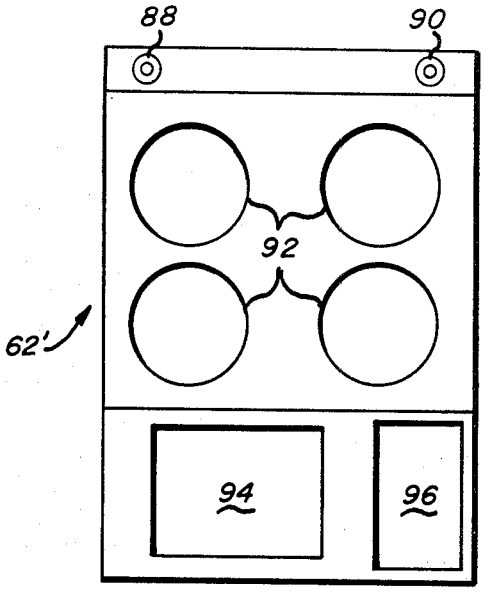
FIG. 6 is a top view of a typical work surface on a processing module.

The modules 14 also each include horizontal work surface 62, best illustrated in FIGS. 1 and 6, which is situated so as to be horizontal and at a comfortable working height for the technician. The interior of the bottom half of the module is a hollow cavity 64 (see FIG. 5) for receiving drawer 60 and also for receiving elements of the work surface 62 which extend downward into the body of the module 14.

Figure 4:
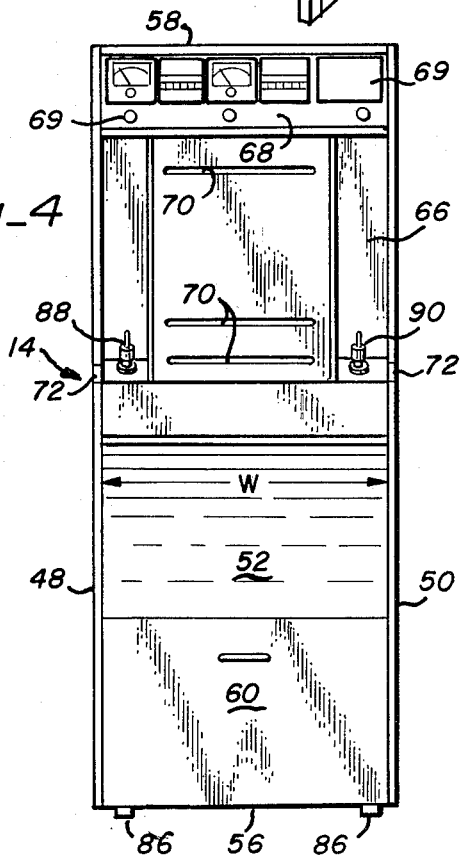
FIG. 4 is a front view of a module.

Situated above the work surface 62 and at the back of the module 14 is an upwardly extending neck 66. Situated at the top of neck 66 is a control panel 68 from which the majority of the operative elements of the module 14 are controlled. As shown in FIG. 4 control panel 68 contains a number of guages, switches and other controls 69 for monitoring and adjusting the portion of the processes and equipment at the module 14. The exact components 69 included will differ from none to a large and varied number depending on the specific purposes of the module 14. In the typical module 14 the neck 66 contains a number of horizontal slits 70 for ventilation purposes. A vacuum created in the neck 66 causes the air over the work surface area 62 to be drawn into horizontal slits 70 to create laminar flow ventilation. This sort of ventilation prevents toxic fumes generated in the vicinity of the work surface 62 from rising upwards and contacting the technician utilizing the work station 10.

Figure 3:
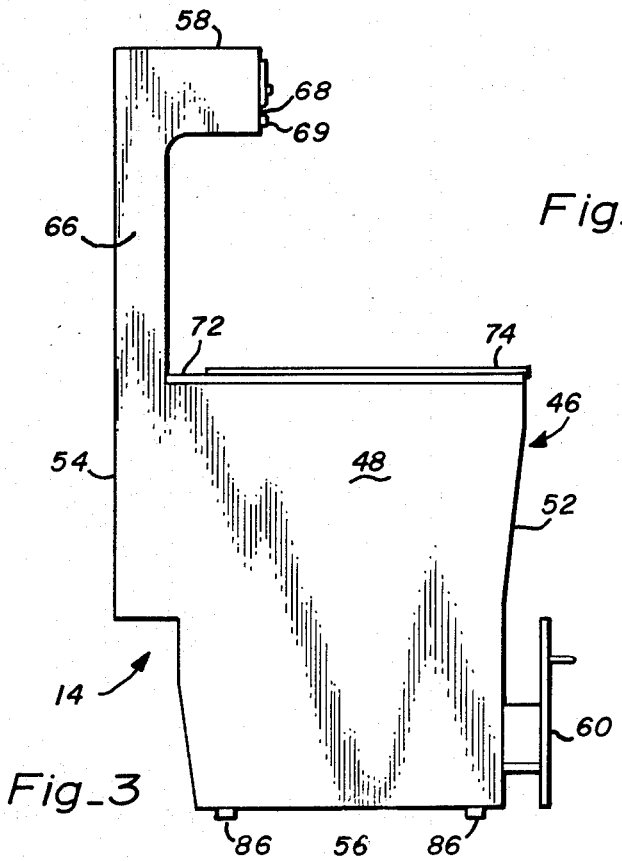
FIG. 3 is a side view of a processing module of the station of FIG. 1.

At the side edges of the work surface 62 the edges of the side members 50 and 52 extend slightly above the work surface to form a side ridge 72 on each side of the work surface. This side ridge 72 prevents spillage and further prevents the flow of materials from the work surface 62 of one module 14 to the adjacent module. In order to maintain the adjacent modules 14 in place next to one another and further to avoid the spillage of any materials between the modules 14, the side ridges 72 on adjacent modules are covered by a ridge guard 74. A typical ridge guard 74 is shown in FIG. 3, partially removed and partially fitting over the side ridge 72. A single ridge guard 74 slidably encompasses the side ridges 72 of both adjacent modules 14 and thus prevents matter from vertically entering the narrow space between adjacent modules 14.

FIG. 5 illustrates the back surface of the module 14. FIG. 5 is a partially cut-away view to illustrate the manner in which the major input and exhaust elements of the module 14 extends from the cavity 64 to mesh with the connections on the plumbing-electrical structure 24. The module 14 includes a first liquid drain pipe 76 and a second liquid drain pipe 78 situated to the back and sides of the cavity 64. Extending from the back of the module 14 beyond the back wall 54 is a exhaust pipe 80. When the module 14 is positioned in the frame 12, the first liquid exhaust pipe 76 mates with first liquid exhaust manifold 36, the second liquid exhaust pipe 78 mates with second liquid exhaust manifold 38 and the gaseous exhaust pipe 80 mates with the associated input port 42 of the gaseous exhaust manifold 40. The module 14 is constructed such that the installation is accomplished by putting the module 14 into position at which time the various exhaust pipes slidably engage the exhaust manifolds without the need for specific connection of each individual element.

The cavity 64 of the module will also typically contain a plurality of input hoses 82 for connection with the flow outlets 34 on the plumbing-electrical structure. The hoses 82 are typically left attached to the module 14. Hoses 82 are designed such that they snap interlock with flow outlets 34 for very easy installation and removal. Input hoses 82 have excess length such that they may be connected to the flow outlets 34 while there is still working distance between the back surface 54 of the module 14 and the plumbing-electrical structure 24. The same is true for one or more electrical plugs 84 which also extend from the interior cavity 64 of the module to connect with the electrical outlets 30 on the plumbing-electrical structure 24.

Modules 14 are installed within the frame 12 by moving them within reasonable proximity to the plumbing-electrical structure 24 and then achieving connection between the input hoses 82 with the flow outlets 34 and the electrical cords 84 with the electrical outlets 30 on the plumbing-electrical structure 24. After this has been achieved, the module 14 is then moved completely into position by tipping it forward, sliding it back and then allowing it to come to rest with the liquid and gaseous exhaust pipes slidably entering the open ends of the liquid and gaseous exhaust manifolds. Because each module 14 is precisely the same shape and the arrangement of elements on the plumbing-electrical structure 24 is identical in configuration for each position 25 within the station 10, this is a very rapid process. Experienced operators can install a module in less than one minute.

Back wall 54 of the module 14 does not extend all the way to the bottom of the module (see FIG. 5). Instead, an open area is left between the edge of wall 54 and bottom wall 56. This allows ready access to cavity 64. Also, drawer 60 extends into this area such that the interior of drawer 60 is accessible from the back of the module 14.

As shown in FIGS. 3, 4 and 5, the entire module 14 is raised slightly off the ground by a number of contact pads 86 situated along the base wall 56. The contact pads 86 prevent the module 14 from coming into direct contact with the floor over a wide surface. This can be important in a chemical situation both to provide proper ventilation underneath the module and also to prevent the module from sticking to the floor over a large area and thus becoming difficult to remove.

A theoretically limitless number of modules for specific purposes can be constructed. The major differences between the modules will occur on the work surface 62, in the control panel 68 and in the varous connections and elements contained within the cavity 64. The degree of ventilation and number of horizontal slits 70 may also be varied. So long as the basic shape and size of the module and the configuration of the elements which interlock with the elements on the plumbing-electrical structure 24 are left unchanged, virtually any modification in the module 14 may be accomplished.

Since the purpose of the multi-phase modular chemical processing station 10 is to provide for chemical processing of elements, and particularly semiconductor wafers, the preferred embodiment includes a number of modules specifically directed to the processing of those wafers. FIG. 6 illustrates a work surface 62' of one module 14 so designed. The work surface 62' illustrates and arrangement for one of the modules 14 adapted for utilization in the chemical processing of semiconductor wafers.

Situated near the back of the work surface 62', and in a similar position of the work surfaces of nearly all of the modules utilized with the station 10, are a liquid washing sprayer 88 and a gaseous sprayer 90. The liquid washing sprayer 88 may be connected by one of the input hoses 82 (see FIG. 5) to a flow outlet 34 on the plumbing-electrical structure for either tap water, distilled water, or deionized water, depending upon the specific requirements of the module utilized. Gaseous sprayer 90 may be connected in a similar manner to a compressed air or compressed inert gas, e.g. nitrogen, flow outlet 34. Sprayers 88 and 90 thus provide a ready and easily operated, operator-controlled method of delivering liquid and/or gaseous materials for which there may be an immediate need in the work area. For example, the liquid sprayer 88 containing water can be used for emergency eye wash purposes as well as for addition to the various chemical processes. The gaseous sprayer 90, when connected to an inert gas such as nitrogen or argon, may be used for extinguishing fires, such as an acid or electrical fire wherein the application of water would be inadvisable.

Forward of the sprayers on the work surface 62' are four high temperature acid baths 92. Each of the acid baths 92 may contain a heated strong acid utilized in the wafer processing procedure. Typical acids utilized are highly concentrated sulfuric acid ($H_2SO_4$), nitric acid ($HNO_3$), and hydrochloric acid (HCl). In the example shown in FIG. 6 the high temperature acid baths 92 are designed to contain heated concentrated sulfuric acid. It is noted that the toxic and caustic chemicals, such as heated concentrated acid, are situated towards the back of the module and away from the operator. This arrangement reduces the opportunity for injury to the operator.

Situated forward of the acid baths are a rinse tank 94 and a holding tank 96. Rinse tank 94 may be used to remove the acid which clings to the wafers and the carriers after they have been removed from the acid baths 92. Holding tank 96 is utilized to contain the wafers and carriers before they are placed in the rinse tank 94.

Figure 7:
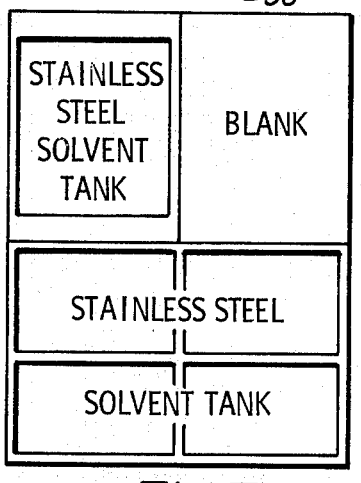
FIGS. 7 through 12 are schematic illustrations of the layout of a number of possible processing modules.
Figure 8:
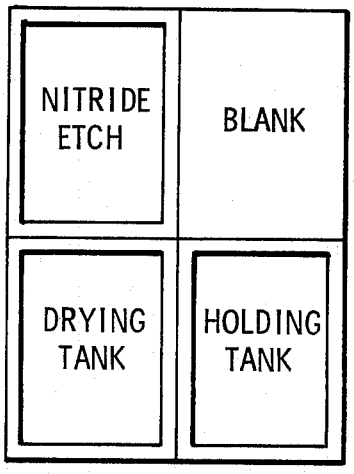
Figure 9:
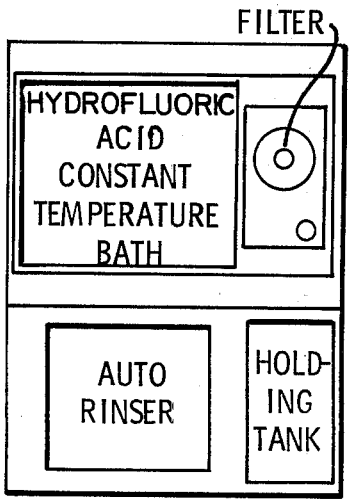
Figure 10:
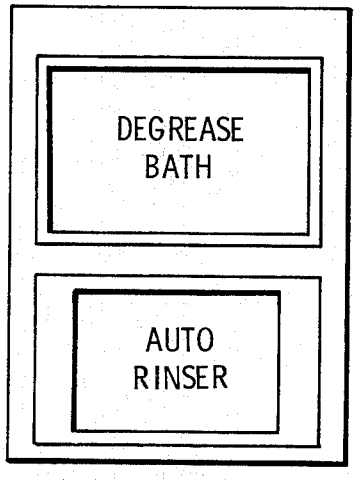
Figure 11:
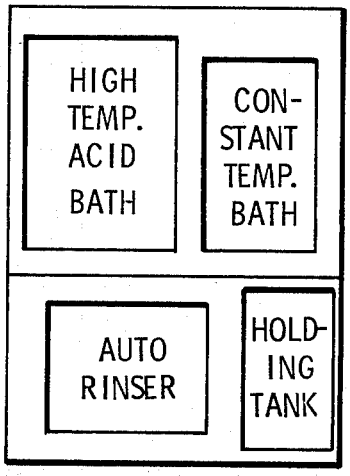
Figure 12:
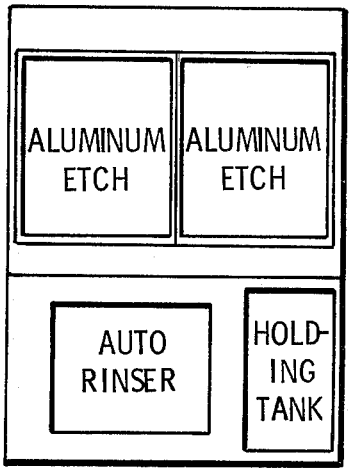

The work surface 62' illustrated in FIG. 6 is just one of the module arrangements presently utilized with the invention. A number of the other modules utilized with the multi-phase modular processing station 10 are illustrated in FIGS. 7 through 12. FIG. 7 illustrates solvent and rinse tanks with a blank, or solid surface for setting down elements. FIG. 8 shows a work surface for nitride etch module. FIG. 9 is a work surface specifically designed for handling hydrofluoric acid (HF), a particularly toxic and caustic acid which is utilized in wafer processing. This chemical must be restricted to containers of specialized materials such as quartz and Teflon as it corrodes ordinary container materials such as glass, most plastics and stainless steel. The constant temperature acid bath is maintained by heaters and circulation pumps situated in the cavity under the work surface. In order to maintain purity and make economical use of the HF it is constantly circulated through a Teflon circulation filter. The remainder of the work surface of FIG. 9 includes a holding tank like the tank 96 of FIG. 6 and an auto rinser similar to rinser 94 of FIG. 6. FIG. 10 illustrates a module work surface adapted for removing organic oils and greases from wafers. FIG. 11 shows a surface containing both a high temperature acid bath and a constant temperature bath, plus a holding tank and auto rinser. FIG. 12 illustrates an aluminum etching module surface for etching the various aluminum components utilized in the industry.

It is again emphasized that the variety of modules is unlimited.

An alternate embodiment of the invention adds vertical ventilation. In this embodiment ventilation means are provided in the overhead member 22 instead of or in addition to in the neck 66. This draws the gaseous exhaust upward off the work surface 62.

The multi-phase modular processing station 10 of the present invention is also particularly valuable in that it provides a relatively large number of module positions 25 within a single processing station 10. Thus, a single set of material and electrical input and exhaust connections to a processing station may be sufficient for a significant amount of processing. A station may also be operated with one or more vacant module positions 25, thus increasing utility and allowing for inherent expansion. Furthermore, since any of the modules may be quickly removed and replaced by any of the other modules, the versatility of the invention is unrivaled. The rapid installation and removal, facilitated by the snap lock hoses and flow outlets and the slidably mating exhaust means, prevents "down time" from ever being a significant problem. It is important only that the present invention is utilized with a sufficient number of replacement modules available.

The chemical processing stations 10 of the present invention are constructed of a variety of materials. The structural members of the frame are typically metal, painted or treated to resist corrosion, while the modules themselves and the plumbing-electrical sructures 24 are ordinarily constructed of high strength plastics. The plastic construction is valuable for its strength and ease of molding while maintaining a light weight for easy maneuverability. Of course, for specific applications, material changes are necessary in the work surface area and other areas likely to be contacted by corrosive chemicals (see FIG. 9). Many plastics utilized for construction are attacked by strong acids such as those utilized on the work surface 62' of FIG. 6 and also be certain organic solvents. In such an application, the plastic portions of the modules 14 will be replaced by glass, quartz, Teflon or metal elements. In each case, the specific construction of the module element must be tailored to the application.

Although the present invention has been described in terms of the presently preferred embodiment, it is to be understood that such disclosure is not to be considered as limiting. Accordingly, it is intended that the appended claims be interpreted as covering all alterations and modifications as fall within the true spirit and scope of the invention.

What is claimed:

1. A multiphase modular chemical processing station comprising:

a fixed plumbing-electrical structure divided into a plurality of discrete module attachment positions including electrical connections and multiple fluid input and exhaust connections for each said position; and a plurality of chemical processing modules, each module being adapted for rapid attachment to or detachment from one of said module attachment positions, each module being self contained for completely performing a desired chemical process independently from each other module.

2. The multiphase modular chemical processing stage of claim 1 wherein the chemical processing modules each include a working surface; and further including a rectangular exterior frame structure enclosing the plumbing-electrical structure and attached modules, the frame including lighting means for illuminating the work surfaces of the modules.

3. The multiphase modular chemical processing station of claim 1 wherein the plumbing-electrical structure further includes an elongated base divided into said discrete module attachment positions, a plurality of liquid and gaseous flow outlets for each such position, a plurality of flow controls for controlling fluid flow through said liquid and gaseous flow outlets to the modules, a first liquid exhaust manifold and a second liquid exhaust manifold separate from said first liquid exhaust manifold for each said position, and a gaseous exhaust manifold for each said position.

4. The multiphase modular chemical processing station of claim 3 wherein the number of said discrete attachment positions is even, said positions are paired, and the first liquid exhaust manifolds, second liquid exhaust manifolds and gaseous exhaust manifolds for each said position is respectively connected to that of said paired position for combined discharge.

5. The multiphase modular chemical processing station of claim 3 wherein each processing module further includes a base, a hollow lower body portion mounted upon said base, said lower body position including opposing left and right side walls, a front wall, a truncated back wall and an upper work surface, a neck portion extending upward from the back of said upper work surface and a top section situated at the top of said neck portion.

6. The multiphase modular chemical processing station of claim 5 in which said base is supported a short distance above the floor or ground by support means attached to the bottom surface of said base.

7. The multiphase modular chemical processing station of claim 5 wherein said hollow lower body portion further includes a removable drawer extending to the lower front thereof and side ridges formed by a short extension above said upper work surface by said left and right side walls.

8. The multiphase modular chemical processing station in claim 5 wherein said truncated back wall extends downward only a short distance from said neck portion such that the interior of said lower body portion is accessible from the rear.

9. The multiphase modular chemical processing station of claim 8 and further including module control means mounted within said top section.

10. The multiphase modular chemical processing station of claim 5 wherein said hollow lower body portion further includes a plurality of material flow containing means for attachment to said liquid and gaseous flow outlets upon the plumbing and electrical structure so as to deliver said material to points on or above said upper work surface, a removable drawer extending into said body at the lower portion of said front wall, liquid exhaust connection means, gaseous exhaust connection means, means for easy attachment and detachment of said upper work surface and a pair of side ridges formed by a short extension above said upper work surface by said left and right side walls.

11. The multiphase modular chemical processing station of claim 10 in which said upper work surface may be replaced by any of a number of chemical processing surfaces and elements including elements extending below said surface into said hollow lower body.

12. The multiphase modular chemical processing station of claim 10 wherein said liquid exhaust connection means include a first liquid drain pipe and a separate second liquid drain pipe, each of said drain pipes extending to points accessible from the back of the module, and said gaseous exhaust means extend from the interior of said neck to a point accessible from the rear of the module.

13. The multiphase modular chemical processing station of claim 12 wherein said first drain pipe slidably mates with said first liquid exhaust manifold, said second drain pipe slidably mates with said second liquid exhaust manifold, and said gaseous exhaust means slidably mates with said gaseous exhaust manifold, respectively with one of said discrete modular attachment positions.

14. The multiphase modular chemical processing station of claim 10 and further including a ridge guard for slidably fitting over the side ridges of adjacent modules to laterally hold the modules in place and to prevent spillage between the modules.

15. The multiphase modular chemical processing station of claim 10 wherein said neck portion includes a perforated front panel extending above and behind said upper work surface and means for drawing gaseous matter through said perforated front panel from the space directly above said upper work surface.

16. The multiphase modular chemical processing station of claim 1 where each processing module slidably engages the fluid exhaust connections of a respective one of said discrete module attachment positions.

* * * * *